US007344406B2

(12) United States Patent
Wolf

(10) Patent No.: US 7,344,406 B2
(45) Date of Patent: Mar. 18, 2008

(54) WIRING HARNESS CONNECTOR FOR A TRUCK TOPPER

(75) Inventor: Robert J. Wolf, Chariton, IA (US)

(73) Assignee: Astoria Industries of Iowa, Osceola, IA (US)

( * ) Notice: Subject to any disclaimer, the term of this patent is extended or adjusted under 35 U.S.C. 154(b) by 0 days.

(21) Appl. No.: 11/382,959

(22) Filed: May 12, 2006

(65) Prior Publication Data

US 2007/0264868 A1 Nov. 15, 2007

(51) Int. Cl.
*H01R 11/00* (2006.01)

(52) U.S. Cl. ..... 439/505

(58) Field of Classification Search ..... 439/502, 439/505, 503; 174/72 A
See application file for complete search history.

(56) References Cited

U.S. PATENT DOCUMENTS 4,802,864 A * 2/1989 Michaels et al. ..... 439/457
5,281,168 A * 1/1994 Krehbiel et al. ..... 439/595
5,490,785 A * 2/1996 Hein et al. ..... 439/76.1
5,890,935 A * 4/1999 Pill ..... 439/752
5,971,799 A * 10/1999 Swade ..... 439/502
6,132,256 A * 10/2000 Morsdorf et al. ..... 439/620.21
6,257,938 B1 * 7/2001 Day et al. ..... 439/723
6,503,098 B2 * 1/2003 Aoki et al. ..... 439/502
6,672,874 B2 * 1/2004 Guthrie ..... 439/34
6,744,147 B2 * 6/2004 Taniguchi et al. ..... 307/10.1
6,746,274 B1 * 6/2004 Verfuerth ..... 439/505
6,840,812 B2 * 1/2005 Devine et al. ..... 439/638
6,935,893 B1 * 8/2005 Flowers et al. ..... 439/595
6,945,822 B2 * 9/2005 Flemming et al. ..... 439/638
7,066,773 B1 * 6/2006 Martin ..... 439/752
2006/0099851 A1 * 5/2006 Duarte et al. ..... 439/502

* cited by examiner

*Primary Examiner*—Tulsidas C. Patel
*Assistant Examiner*—Vladimir Imas

(57) ABSTRACT

A wiring harness connector having a wire divider with a housing that receives wiring from an electrical system of a truck. The wire divider is connected to an electrical adapter that has pins that electrically and physically connect to the wiring system of the truck. The electrical adapter additionally is electrically connected to both a male and female receptacle such that corresponding male or female receptacles may be connected to the electrical system of a truck topper or an auxiliary device.

6 Claims, 5 Drawing Sheets

WIRING HARNESS CONNECTOR FOR A TRUCK TOPPER

BACKGROUND OF THE INVENTION

This invention relates to electrical connections to truck toppers. More specifically, this invention relates to a wiring harness connector that is wired into a truck's electrical system to provide efficient electrical connections between the vehicle's electrical system and the wiring system of a truck topper or a trailer hauled by the truck.

Many individuals cover the bed of their truck to ensure that items do not fly out of the bed of the truck during operation. One way of covering a bed of a truck is by using a truck topper. Most truck toppers have a back end that has a light thereon to bring attention to the topper when driving at night. Currently, in order to power the back light of the truck topper one must splice the wiring of the truck and connect the wiring system of the topper light to the truck wiring system by hard wiring these wires together.

Though effective there are many instances wherein this wiring needs to be disconnected. For example, when a truck is used to haul a trailer to carry a boat, the electrical system of the truck must be connected to the electrical system of the trailer such that the back brake lights of the trailer properly operate to alert other drivers on the road when an individual is braking. Currently, in order to power the trailer back lights the hard wiring connection between the truck electrical system and the topper back light must be disconnected and then this wiring must be spliced with the electrical system of the trailer. Then, when the trailer is no longer in use the trailer and vehicle wiring connection must be disconnected and the topper and vehicle connection must be hard wired again. This process is not only time consuming but additionally can cause damage to the wiring systems. Another instance wherein the truck topper wiring needs to be disconnected from the vehicle wiring is when items are being hauled such that the topper needs to be removed from the bed.

Thus, it is a primary objection of the present invention to provide an apparatus that efficiently connects and disconnects the electrical wiring within a vehicle to a truck topper.

Yet another object of the present invention is to provide an apparatus that reduces wear on the electrical wiring of a vehicle.

These and other objects, features, or advantages of the present invention will become apparent from the specification and the claims.

BRIEF SUMMARY OF THE INVENTION

A wiring harness connector used to connect the electrical wiring of a truck to a truck topper and/or an auxiliary device. The wiring harness connector comprises a wire divider that receives the wiring of a truck within cavities within its housing. The wire divider matingly connects with an electrical adapter having prong or pin members that are disposed within the housing of the wire divider to electrically connect the truck wiring to the electrical adapter. The pins are physically and electrically connected to primary wires that are physically electrically connected to first and second auxiliary wires. The first auxiliary wire is electrically connected to a female receptacle whereas the second auxiliary wires are electrically connected to a male receptacle. Then depending on the application the male or female receptacles may be electrically connected to the wiring of a truck topper or an auxiliary device such as the electrical system of a trailer.

DETAILED DESCRIPTION OF THE PREFERRED EMBODIMENT

Figure 1:
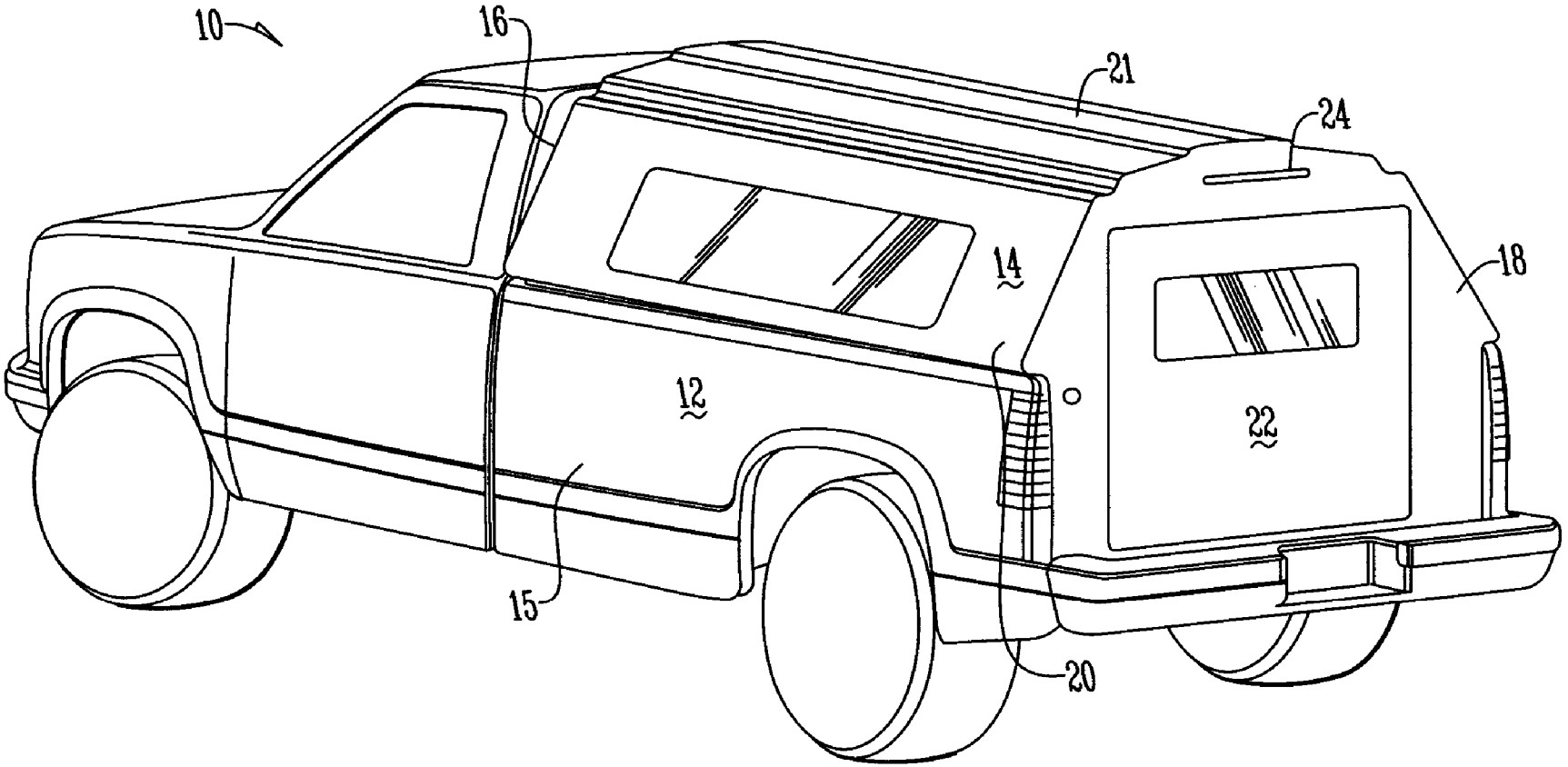
FIG. 1 is perspective view of a truck with a truck topper.

With reference to the figures, a truck or vehicle 10 having a bed 12 is shown having a topper 14 for placement on the sidewalls 15 of the truck 10. The topper 14 has a front end 16, rear end 18, sides 20 and a top 21. The rear end 18 has a door 22 and a light 24 above the door.

Figure 2:
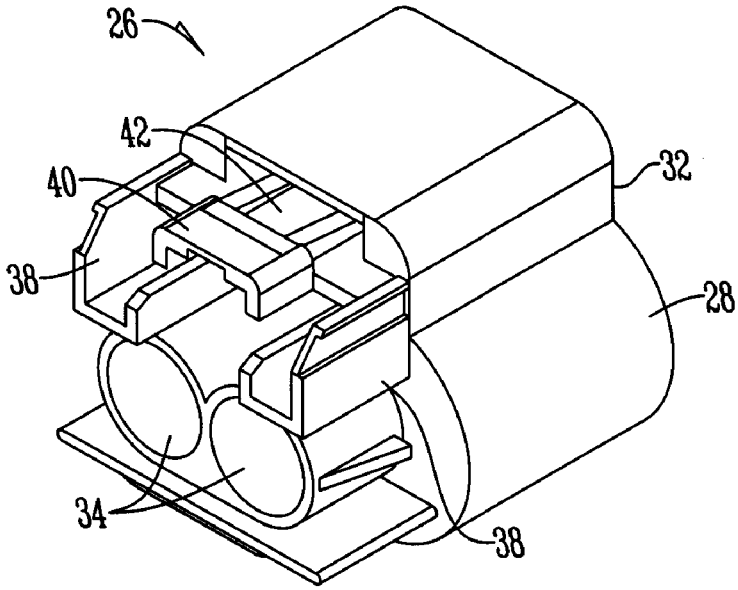
FIG. 2 is a front perspective view of a wire divider.
Figure 3:
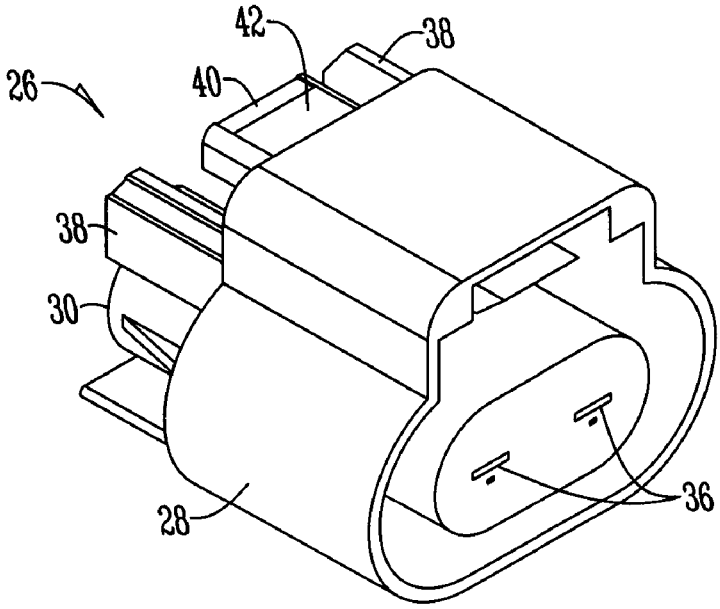
FIG. 3 is a back perspective view of a wire divider.
Figure 4:
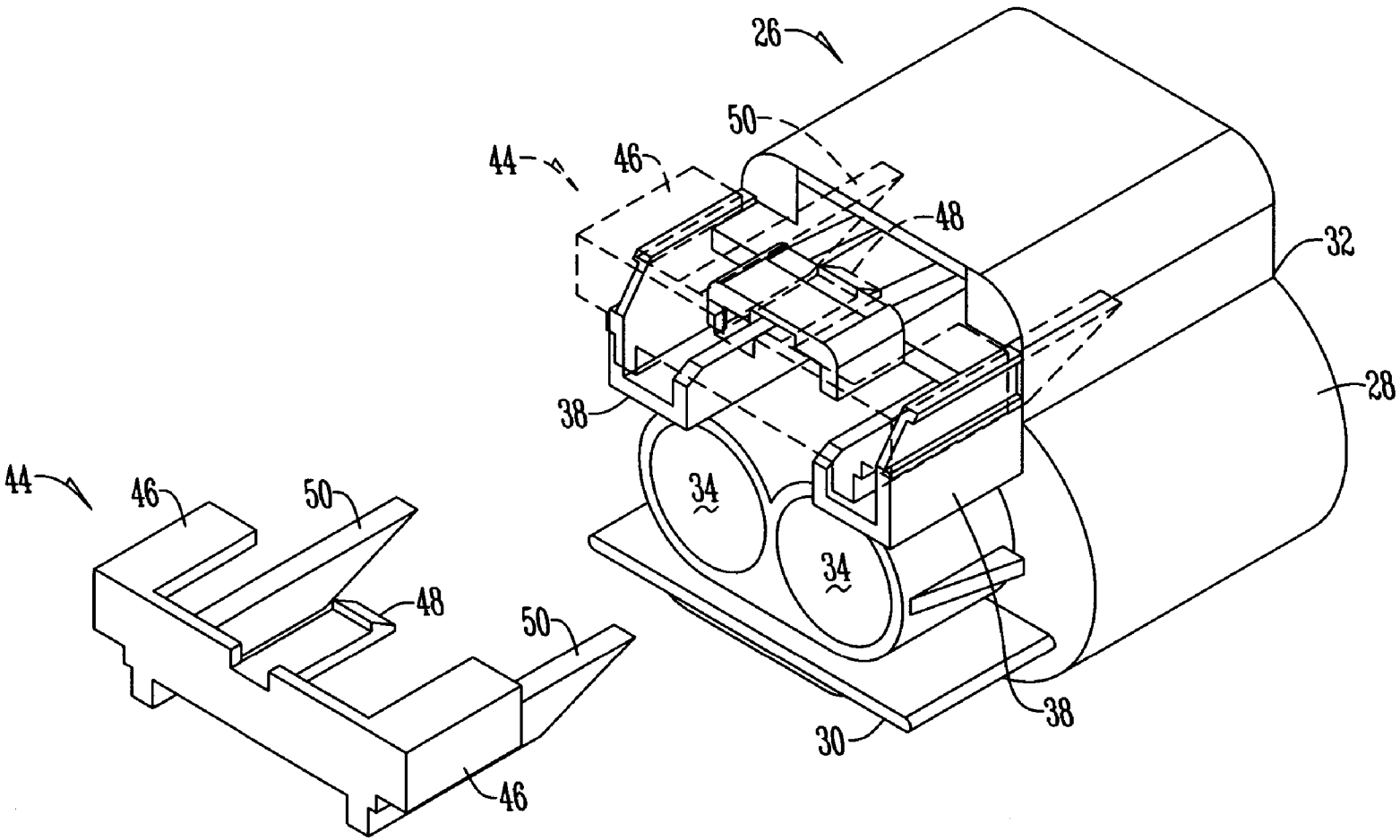
FIG. 4 is a front perspective view of a wire divider with a connector position assurance device.
Figure 5:
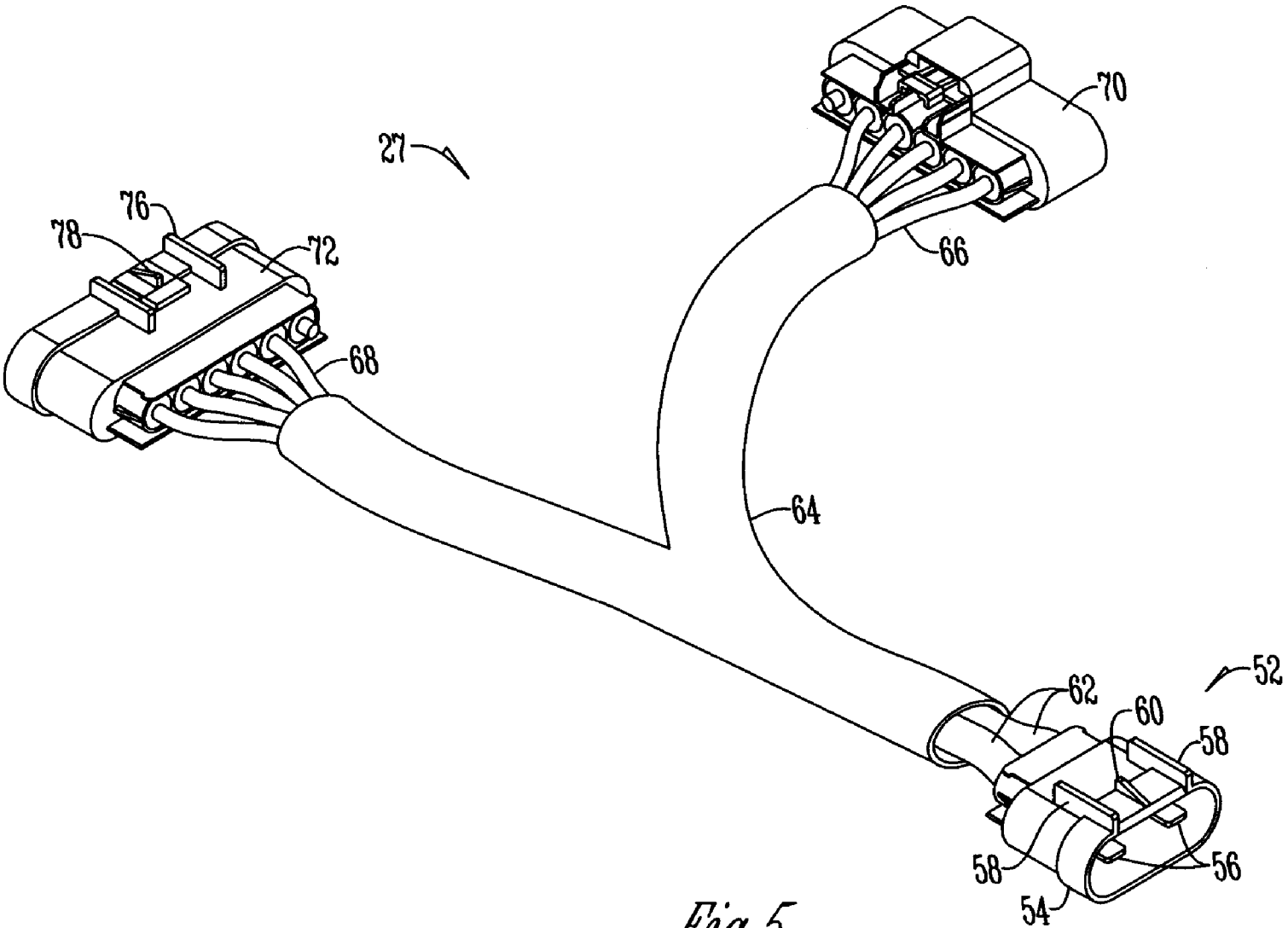
FIG. 5 is a perspective view of a wiring harness connector.
Figure 6:
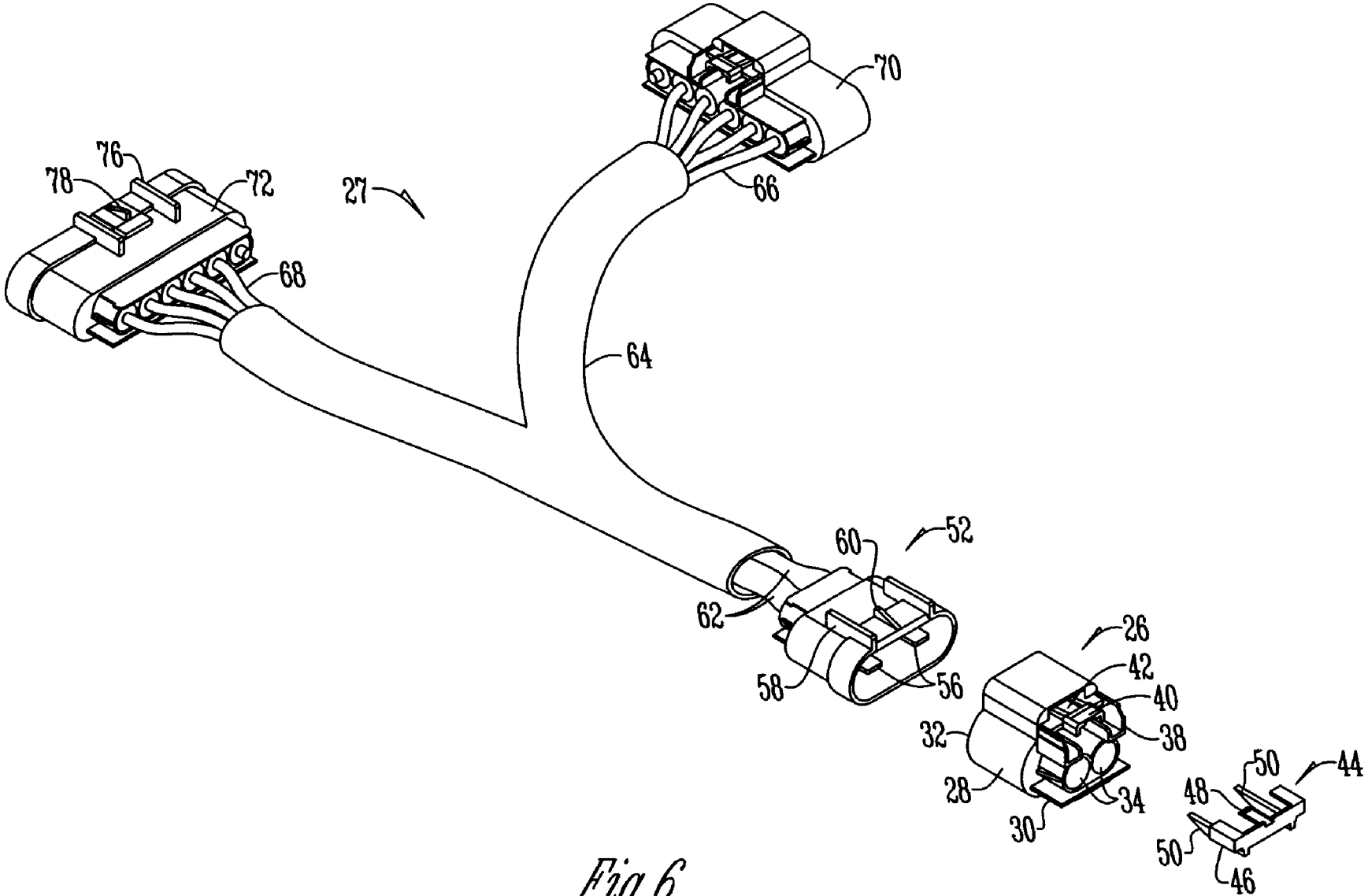
FIG. 6 is a perspective view of a wiring harness connector.

FIGS. 2-3 show a wire divider 26 of a wiring harness connector 27 (FIGS. 5-6). The wire divider 26 has a housing 28 with a first and second ends 30, 32 respectively. The first end 30 has a set of cylindrical cavities 34 disposed through the housing 28 and terminating at the second end 32 as a pair of slots 36. At the first end 30 below the cylindrically shaped cavities 34 are a pair of inverted U-shaped channels 38 with a key entry 40 disposed between. The key entry 40 has an opening 42 in its bottom surface such that the first end 30 is shaped to receive a connector position assurance device 44 (FIG. 4).

A connector position assurance device 44 has a pair of sideways J-shaped channels 46 having an indentation 48 disposed therebetween and a set of rails 50. Thus, the rails 50 of the connector position assurance device 44 slide within the U-shaped channels 38 of the wire divider 26 thus allowing the indentation 48 to snap into the opening 42 within the key entry 40.

As best seen in FIG. 4 the second end 32 of the wire divider is received within an electrical adapter 52 that has a housing 54 containing a set of pins or prongs 56 that are of size and shape to fit within the slots 36 of the wire divider 26 in order to physically and electrically connect the pins 56 to wiring of the truck that is disposed through the cylindrical cavities 34. The electrical adapter 52 additionally has a set of rails 58 and an indentation 60 to align the electrical adapter within the housing 28 of the wire divider 26 such that the indentation 60 fits securably within the opening 42 of the key entry 40 to secure the wire divider 26 and electrical adapter 52 together.

Electrically and physically connected to the pins 56 are a pair of primary wires 62 that are connected to the pins 56 and disposed through and away from the housing 54. The primary wires 62 are surrounded by a protective sleeve 64 that prevents the wires from being exposed to the outside environment.

In a preferred embodiment the primary wires 62 are physically and electrically connected to a first and second set of auxiliary wires 66, 68 within the sleeves wherein the first set of auxiliary wires are electrically connected to a female receptacle 70 whereas the second set of auxiliary wires 68 are electrically and physically connected to a male receptacle 72.

The male receptacle 72 has a rail 76 and indentation 78 connection device for connecting with a female receptacle. Meanwhile the female receptacle 70 receives pin members of a male receptacle and additionally has a keyway entry for securably receiving a male receptacle. As with the wire divider 26 a connector position assurance device 44 may be used in association with the female receptacle 70 to assure the correct positioning during connection.

In operation wires from the wiring system of the truck 10 are placed within the cylindrical cavities 34 of housing 28 of wire divider 26. A connector position assurance device 44 is used to ensure the correct position of the truck wiring. Then the wire divider 26 is connected to an electrical adapter 52 such that the pins 56 fit within the slots 36 of the housing 28 of the wire divider 26 to electrically connect the wiring of the truck 10 to the electrical adapter 52. Thus, the male and female receptacles 70, 72 are electrically connected the wiring system of the truck 10. Therefore the wiring system of the truck topper 16 need only be connected to a male or female receptacle such that the harness receptacle 26 and the topper receptacle may easily engage and disengage.

Similarly, an auxiliary device such as the electrical system of a trailer may have a male or female receptacle placed thereon for a simple connection with a receptacle 70, 72 of the harness 27. Thus, the electrical system of the truck 10 is easily and efficiently connected and disconnected to the electrical systems a topper 14, or an auxiliary device such as a trailer. By using the harness 27 time is saved and wear on the wiring is minimized. Consequently, at the very least, all of the objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A wiring harness connector comprising:

a wire divider having a housing and at least one cavity disposed within the housing adapted to receive wires from a wire system;

said wire divider having a pair of inverted U-shaped channels with a key entry having an opening disposed between and adjacent to the at least one cavity;

a position assurance device having rails and an indentation wherein the rails slide within the inverted U-shaped channels and the indentation snaps into the opening of the key entry to connect to the wire divider to ensure the correct position of the wires;

an electrical adapter having at least one pin disposed within a cavity of the wire divider;

a primary wire electrically connected to a prong and disposed through the electrical adapter and electrically connected to a first electric receptacle.

2. The wiring harness of claim 1 wherein the primary wire is electrically connected to an auxiliary wire that is connected to a second electric receptacle.

3. The wiring harness of claim 2 wherein the first electric receptacle is a male receptacle and the second electric receptacle is a female receptacle.

4. The wiring harness of claim 1 wherein the primary wire and auxiliary wire are contained within a sleeve.

5. The wiring harness of claim 1 wherein the wire divider has a pair of cylindrical cavities terminating in first and second slots of size and shape to receive a first and second pins from the electrical adapter.

6. The wiring harness of claim 1 wherein the electrical adapter has a set of rails and an indentation that align the electrical adapter within the housing of the wire divider to secure the wire divider and electrical adapter together.

* * * * *